US007698774B1

(12) United States Patent
Coon

(10) Patent No.: US 7,698,774 B1
(45) Date of Patent: Apr. 20, 2010

(54) APPARATUS FOR PRODUCING AN ARCUATE BLADE

(76) Inventor: Darren M. Coon, 68 Lacey La., Brockport, NY (US) 14420

( * ) Notice: Subject to any disclaimer, the term of this patent is extended or adjusted under 35 U.S.C. 154(b) by 1241 days.

(21) Appl. No.: 11/235,453

(22) Filed: Sep. 26, 2005

(51) Int. Cl.
*E01C 19/12* (2006.01)

(52) U.S. Cl. ..... 15/235.8; 15/245.1; 425/458

(58) Field of Classification Search ..... 15/235.8, 15/235.4; 24/486; 425/458; 30/492, 337; 72/380
See application file for complete search history.

(56) References Cited

U.S. PATENT DOCUMENTS

| | | | | |
|---|---|---|---|---|
| 109,073 | A | | 11/1870 | Steeler |
| 952,971 | A | | 3/1910 | Wolary |
| 1,067,301 | A | * | 7/1913 | Bricker ..... 15/235.8 |
| 1,083,099 | A | | 10/1913 | Howg |
| 1,999,367 | A | | 4/1935 | McCorkle |
| 2,178,899 | A | | 2/1939 | Shaffer |
| 2,301,498 | A | * | 11/1942 | Ames ..... 15/235.8 |
| 2,947,017 | A | | 8/1960 | Dybdahl |
| 2,968,057 | A | | 1/1961 | Pratt |
| 3,341,878 | A | | 9/1967 | Hubbard |
| 3,878,581 | A | | 4/1975 | Perna |
| 4,097,951 | A | | 7/1978 | Hurtt |
| 4,253,214 | A | | 3/1981 | Bushee |
| 4,619,013 | A | | 10/1986 | Yon |
| 4,631,019 | A | | 12/1986 | House |
| 4,731,258 | A | | 3/1988 | Liberman |
| 4,784,598 | A | | 11/1988 | Kranz |
| 5,122,006 | A | * | 6/1992 | MacMillan ..... 401/5 |
| 5,351,357 | A | | 10/1994 | Liberman |
| 6,880,198 | B1 | | 4/2005 | Hazard |

* cited by examiner

*Primary Examiner*—Joseph J Hail, III
*Assistant Examiner*—Jamal Daniel
(74) *Attorney, Agent, or Firm*—Hiscock & Barclay, LLP

(57) ABSTRACT

Disclosed in this specification is an assembly for bending the blade of a drywall knife. In one aspect of the invention, a first and second blade bender are each attached to a drywall knife and a force is applied. This force bends the blade in such a manner that an arcuate blade is produced. The magnitude of the bend is highly adjustable.

14 Claims, 12 Drawing Sheets

FIG. 7A
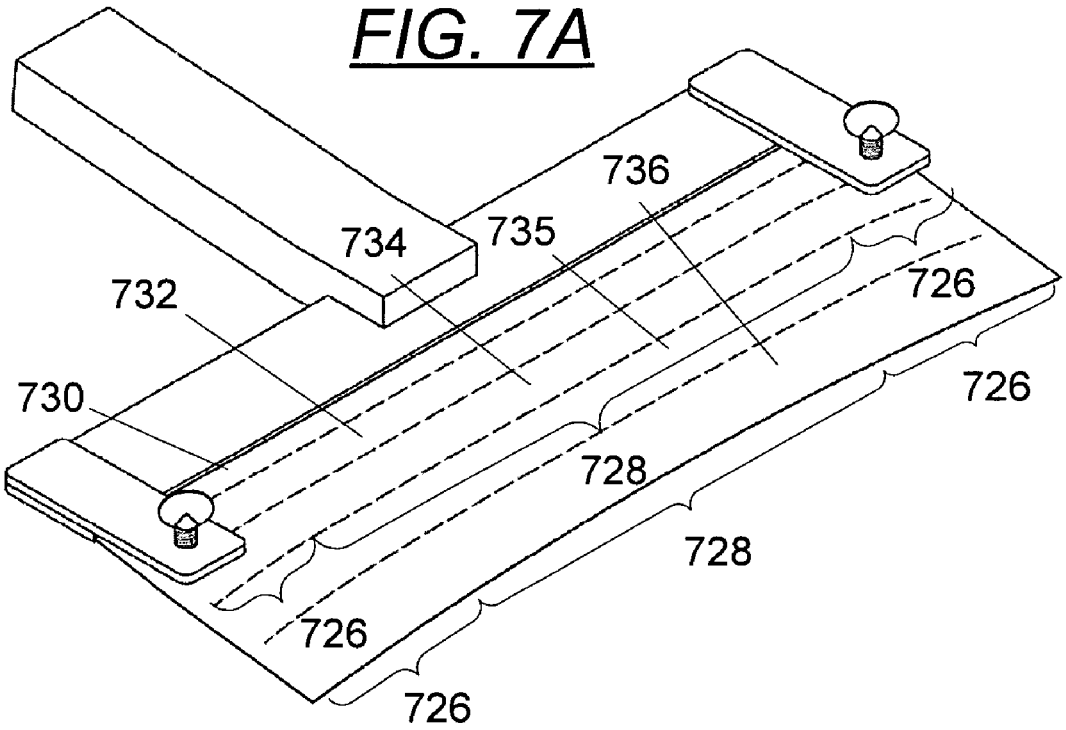
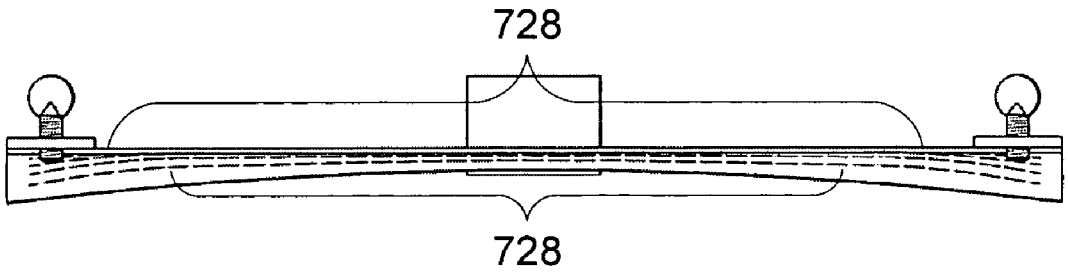
FIG. 7B

APPARATUS FOR PRODUCING AN ARCUATE BLADE

FIELD OF THE INVENTION

This invention relates generally to tools and handheld implements such as a mason's trowel or float, and specifically to an adjustable drywall blade useful for finishing drywall.

BACKGROUND OF THE INVENTION

Conventional drywall is installed in segmented pieces. Each one of these segments is placed adjacent to other segments, thereby creating seams between the pieces. A great deal of work must be done to conceal these seams. A skilled operator is often required to apply multiple coats of filler material. The first coat of such filler is carefully worked into the seam or over tape which covers the seam. On each successive coat, the user must adjust the angle, pressure, and distance the drywall knife blade is offset from the seam. This multiple-step operation has been necessitated by the fact that the conventional knife is flat, while the joint compound formation it is used to create is curved. This multiple-step operation has also been necessitated by the propensity of the conventional knife to produce air pockets in the filler and to urge filler out the sides of the blade. Multiple coats of filler are applied such that a gradual, crowned (i.e. convex) surface of filler is placed over the seam. The thickest layer of filler is disposed directly over the seam or tape, and the thickness of the filler gradually decreases until it becomes flush with the wall. This gradual change in the thickness of the filler must be subtle enough that the casual observer will not take note of the filler material itself and instead see only an apparently flat wall. Thus, the spreading of the filler over the adjacent drywall sections, and the rest of the drywall sections, has been tedious, time consuming, and requires great skill.

The same conventional knife that has been used to apply the joint compound, or the like, to the tape and adjoining wall sections has also been used to spread plastic compounds to smooth surface irregularities on other planar surfaces. This can also be a tedious, time consuming, skill-requiring task due to the aforementioned characteristics of the conventional knife.

Previous attempts to address similar drywall related issues have been attempted in the prior art, but none has proven entirely satisfactory. Reference may be had to U.S. Pat. Nos. 109,073 to Steeter (Improvement in Corner Trowel); 952,971 to Wolary et al. (Trowel); 1,067,301 to Bricker (Trowel); 1,083,099 to Howg (Adjustable Plastering Trowel); 1,999,367 to McCorkle (Trowel); 2,178,899 to Shaffer (Trowel); 2,947,017 to Dybdahl (Wallboard Joint Finishing Tool); 2,968,057 to Pratt (Adjustable Contour Knife); 3,341,878 to Hubbard (Hand Finishing Tool); 3,878,581 to Perna (Finishing Tool for Wallboard Surfaces); 4,097,951 to Hurt (Spreader having integrally molded deformable handle and bendable blade); 4,253,214 to Bushee (Finish work trowel); 4,619,013 to Yon (Wall Corner Finishing Tool); 4,631,019 to House (Combination applicator and shaper for moldable materials); 4,731,258 to Liberman (Method for applying plaster and cement to wallboard and the like); 4,784,598 to Kranz (Drywall tool); 5,351,357 to Liberman (Spreader tool for applying bonding compounds to planar surfaces; and 6,880,198 to Hazard (Adjoining Surface Device for Working Viscous Materials). The content of each of the aforementioned patents is hereby incorporated by reference into this specification.

Each of these approaches are deficient in that none of the tools teach a method for bending existing drywall blades; instead a specialized blade must be purchased. Moreover, these approaches are deficient in that such tools fail to properly steer the filler material to the center of the blade, and thus are inefficient.

It is an object of this invention to provide at least one of the following:

(1) a blade bender configured to be attached to a drywall blade which acts so as to bend the blade at an adjustable angle. Such a blade bender is adapted to fit at least one commercially available drywall blade, (2) a kit comprised of two substantially identical blade benders configured to bend the blade of a drywall knife, (3) an assembly comprised of a drywall knife blade and two blade benders configured to bend the blade such that the blade achieves an arcuate edge, (4) provide an arcuate drywall knife that is significantly less costly and more easily manufactured than prior art drywall knifes, and/or (5) provide a tool that allows a user to apply filler compounds to a section of drywall wherein a lower level of skill is required.

SUMMARY OF THE INVENTION

In accordance with the present invention, there is provided a first blade bender and second blade bender, each of which are comprised of an upper arm, a threaded hole and a threaded screw, a drywall knife blade, the two blade benders being placed at two ends of the blade, the two blade benders are each comprised of a first section contiguous with, and flexibly mounted to, the front of the blade and a second section contiguous with, and securely mounted to, the rear of the blade; the threaded screws are mounted in the first section such that operation of the screws causes a force to bend the blade.

The technique described above is advantageous because it can be adapted to any number of drywall knifing blades. The technique described above is also advantageous in that it permits the operator to quickly and easily control the degree to which the blade is bent in a highly accurate manner.

BRIEF DESCRIPTION OF THE DRAWINGS

The invention will be described by reference to the following drawings, in which like numerals refer to like elements, and in which:

FIG. 7A and FIG. 7B are perspective and end views of one bend blade of the present invention;

Figure 1:
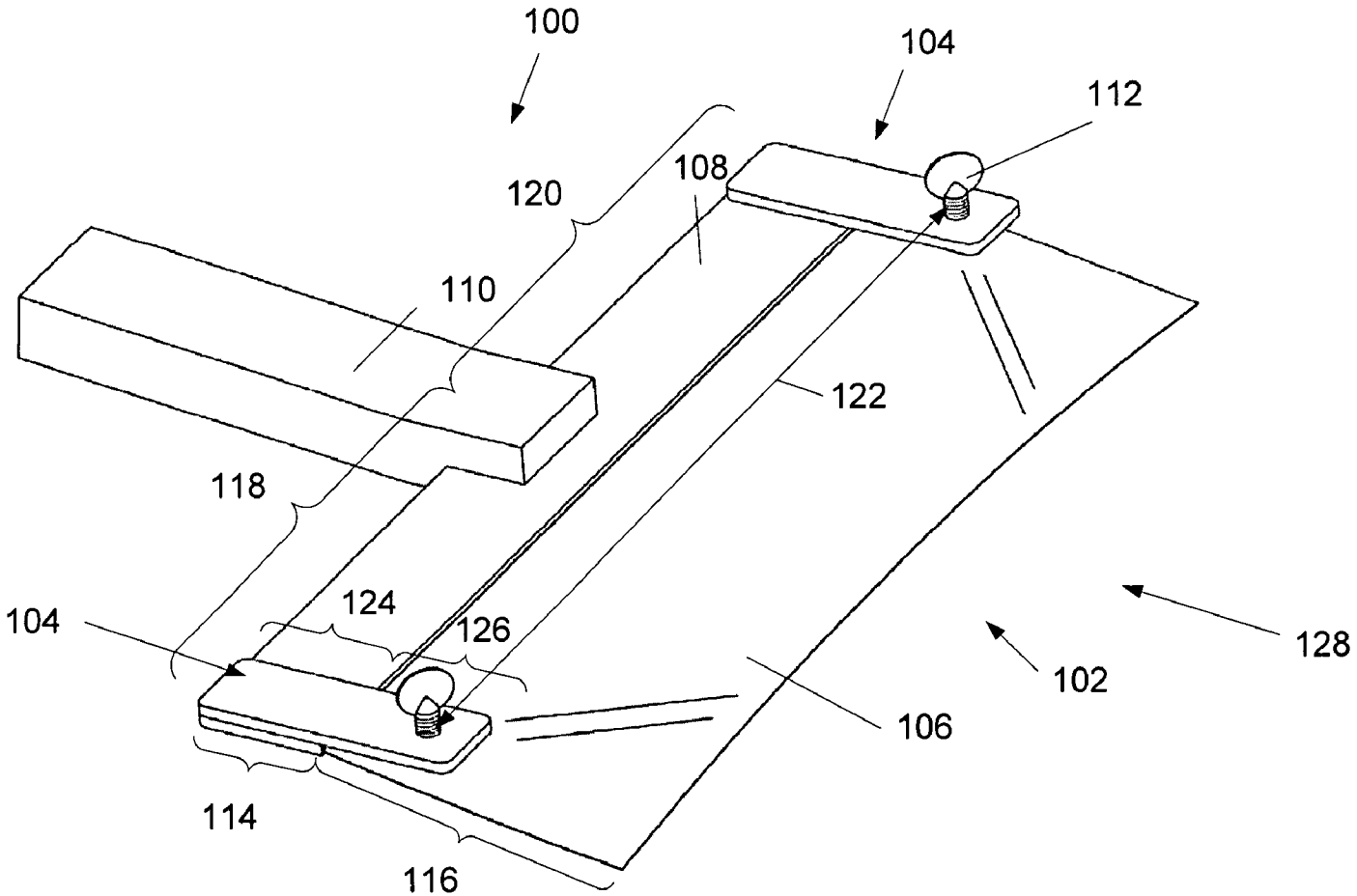
FIG. 1 is a perspective view of one assembly of the invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements.

FIG. 1 is a perspective view of one assembly of the invention. As illustrated in FIG. 1, assembly 100 is comprised of drywall knife 102 and first and second blade benders 104. Drywall knife 102 is comprised of blade 106, backing plate 108, and handle 110. Such drywall knifes are commercially available and may be found in virtually any hardware store. In one embodiment, blade 106 is constructed from a durable metal, such as aluminum, steel, or stainless steel, and has a thickness such that it is substantially flexible. In another embodiment, blade 106 is constructed from a plastic. In some embodiments of the invention, the assembly is coated with a layer of protective material which increases the durability of the assembly. In one such embodiment, the assembly is coated with a layer of polymeric material, such as Teflon. In another embodiment, the assembly is coated with a layer of titanium. Blade 106, in turn, is comprised of rear blade section 114, front blade section 116, proximal side 118 and distal side 120. Backing plate 108 acts on blade 106 in such a way as to make rear blade section 114 substantially rigid. The term "substantially rigid" means that the rear blade section remains substantially co-planar throughout the ordinary use of the drywall knife assembly. Likewise, and with reference to the substantially flexible nature of blade 106, the term "substantially flexible" means that the front blade section 116 may be bent such that it becomes non-co-planar with respect to rear blade section 114 when a force is applied, but returns to co-planarity when the force is removed. The blade benders 104 are comprised of first and second threaded screws 112. First and second blade benders 104 are separated by distance 122. Specifically, distance 122 is the distance between the first and second threaded screws 112. In the embodiment depicted in FIG. 1, the distance 122 is such that blade benders 104 are flush with proximal side 118 and distal side 120. As will be apparent from inspection of FIG. 1, FIG. 2, and from the description provided herein, blade benders 104 are configured such that blade 106 may be bent by operation of threaded screws 112 which apply a force to blade 106, thus causing blade 106 to bend. The configuration of blade benders 104 is illustrated to FIG. 2A and FIG. 2B.

Figure 2A:
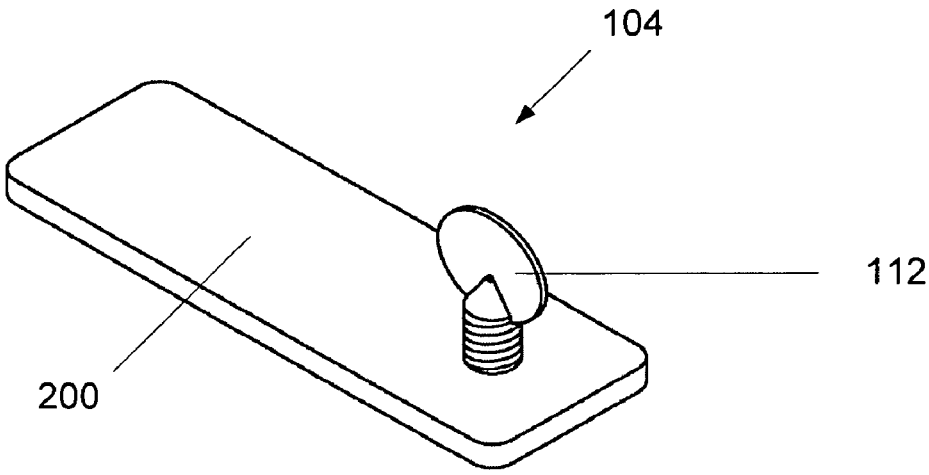
FIG. 2A and FIG. 2B are a perspective view and profile view, respectively, of blade bender 104 of FIG. 1.
Figure 2B:
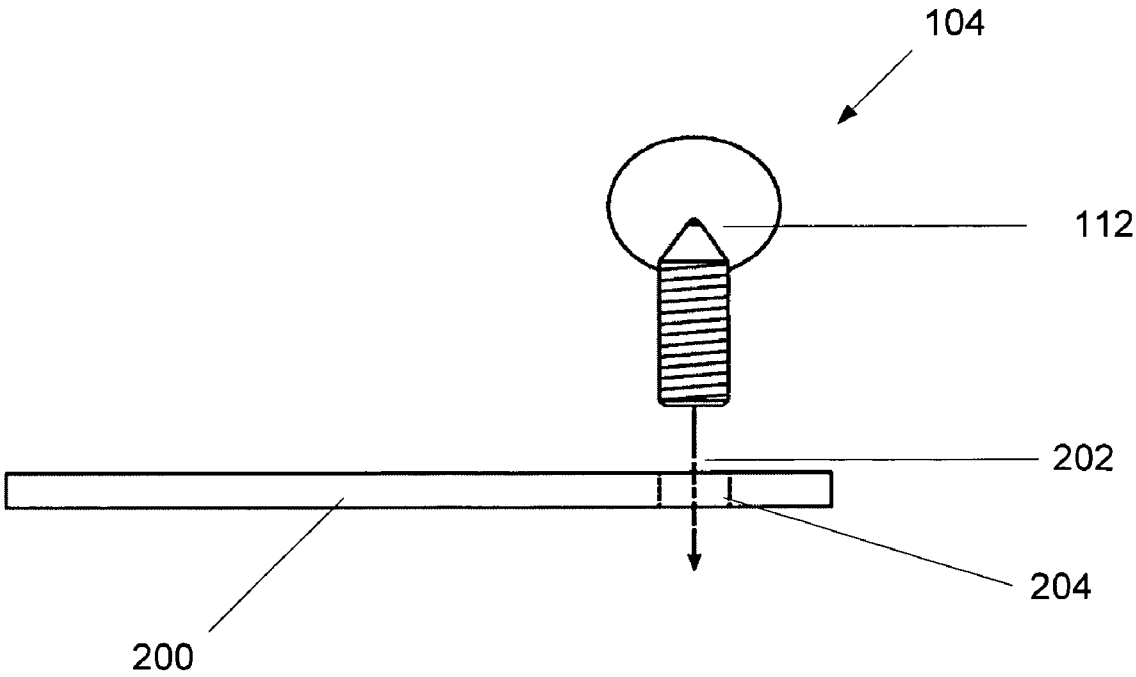

FIG. 2A is a perspective view of blade bender 104 of FIG. 1. As seen in FIG. 2A, blade bender 104 is comprised of upper arm 200 and threaded screw 112. FIG. 2B provides a profile view of blade bender 104, wherein it can be seen that upper arm 200 has a threaded hole 204, which is configured to receive threaded screw 112. When threaded screw 112 is operated, such operation causes threaded screw 112 to translate through threaded hole 204, thus translating in direction 202. Referring again to FIG. 1, it can be seen that, when such a translation occurs, a force will be applied to blade 106 which will cause blade 106 to be bent downward. Thus, threaded screw 112 is one means for applying a force to front blade section 116 (see FIG. 1). Any other suitable means for applying a force to the front blade section 116 may also be used. For example, one may use a cam, a wedge, a spring, a bolt or levers. The magnitude of bending will be proportional to the magnitude of the force applied. In one embodiment, the magnitude of the force applied is adjusted by controlling the number of revolutions of threaded screw 112. In another embodiment, the force is adjusted by operation of a lever. In another embodiment the force is applied by a wedge. In one such embodiment, this force is not adjustable. Other suitable means for adjusting the force will be apparent to those skilled in the art and with vary depending upon the means for applying the force.

Referring again to FIG. 1, the upper arm 200 (see FIG. 2A) of blade bender 104 has a first section 126 contiguous with, and flexibly mounted to, the front blade section 116 and a second section 124 contiguous with, and securely mounted to, the rear blade section 114. As used in this specification, the term "securely mounted to" means that the routine use of the assembly for its intended purpose will not dislodge second section 124 from rear blade section 114. Such means for securely mounting include, for example, welding, adhesives, mounting screws or bolts, a lower arm (see elsewhere in this specification) or any other suitable means for attaching the two members. Such means for securely mounting may be removable, such as a removable screw or the lower arm taught elsewhere in this specification, or substantially irremovable, such as welding. As used in this specification, the term "flexibly mounted to" means that the front blade section 116 will bend out of co-planarity with respect to the plane defined by the substantially rigid rear blade section 114 when a force is applied to front blade section 116, but will return to co-planarity when the force is removed.

Figure 3:
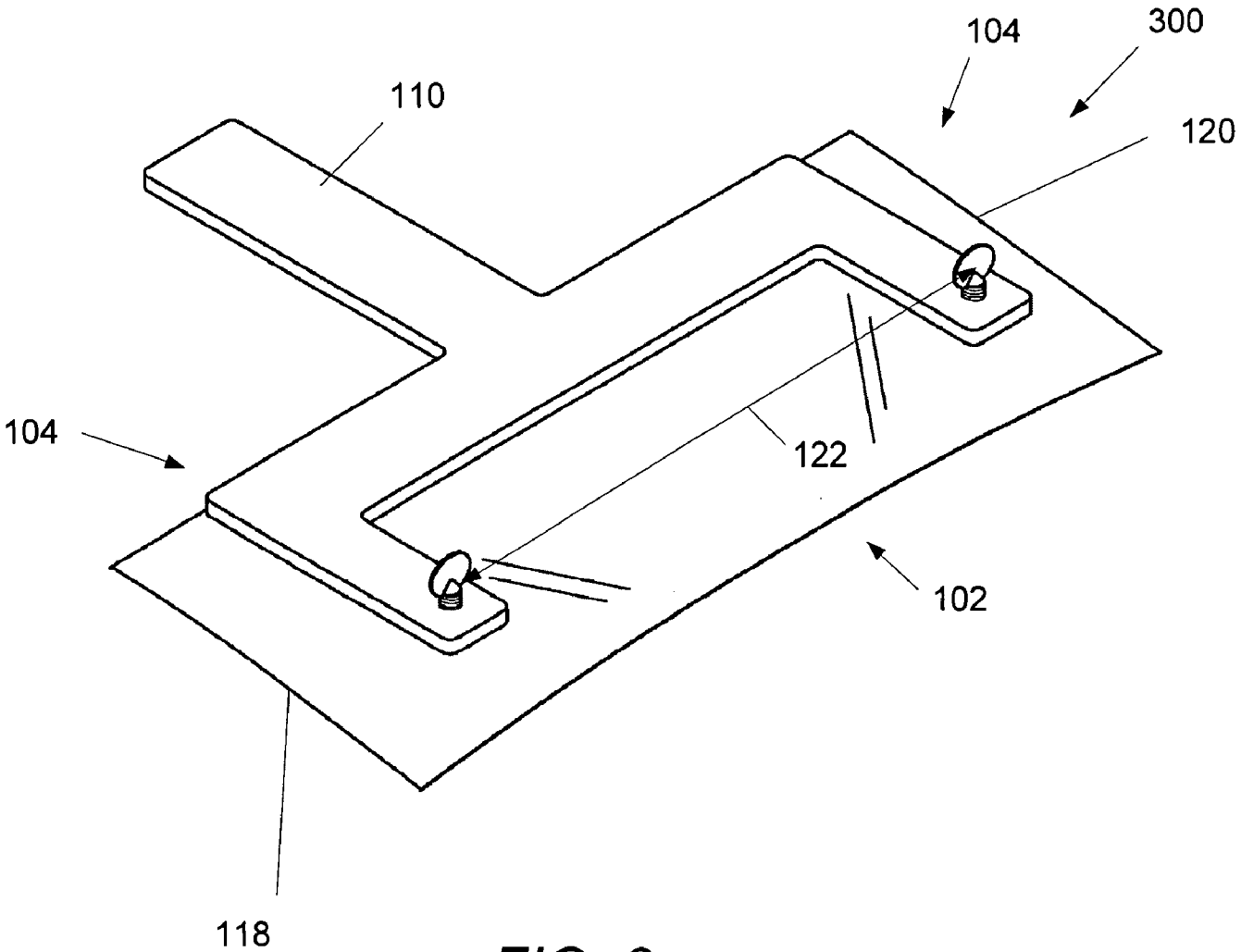
FIG. 3 is a perspective view of another assembly of the present invention.

FIG. 3 is a perspective view of another assembly of the present invention. As shown in FIG. 3, assembly 300 is similar to assembly 100 of FIG. 1 except in that drywall knife 102 is comprised of blade 106 and handle 110, but lacks a backing plate, such as backing plate 108 of assembly 100. It is therefore clear that such a backing plate is optional. In such an embodiment, an alternative method for making rear section 114 substantially rigid may be provided. For example, one may simply increase the thickness of the blade 106 throughout rear blade section 114. The apparatus 300 also differs in that the distance 122 is such that the blade benders 104 are disposed near, but not flush with, proximal side 118 and distal side 120. In one embodiment of the invention, distance 122 between threaded screws 112 is from about three centimeters to about sixty one centimeters. In another embodiment, distance 122 is from about fifteen centimeters to about thirty six centimeters. In yet another embodiment, distance 122 is from about twenty five to about thirty six centimeters. In another embodiment, the distance 122 is from about twenty eight centimeters to about thirty centimeters.

Figure 4:
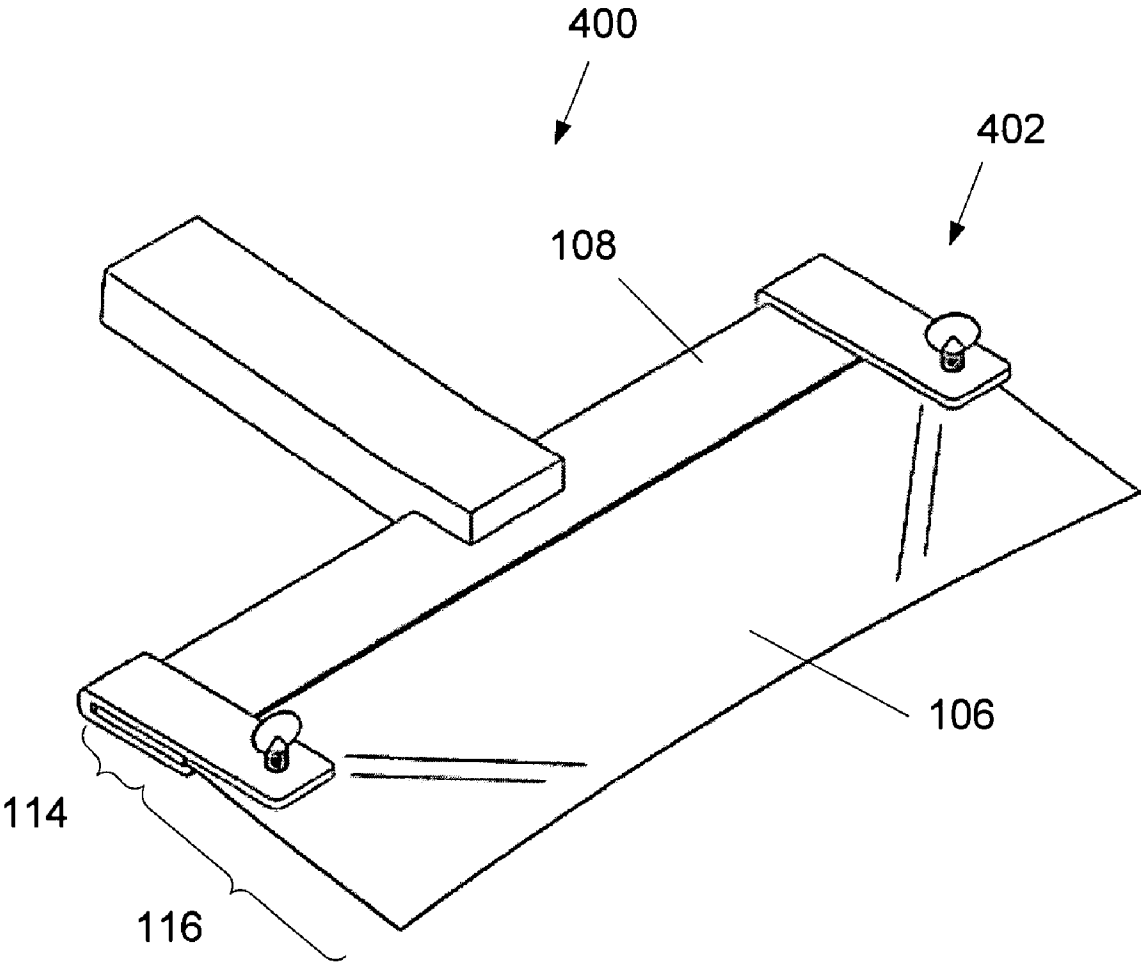
FIG. 4 is a perspective view of another assembly 400 of the present invention.
Figure 5:
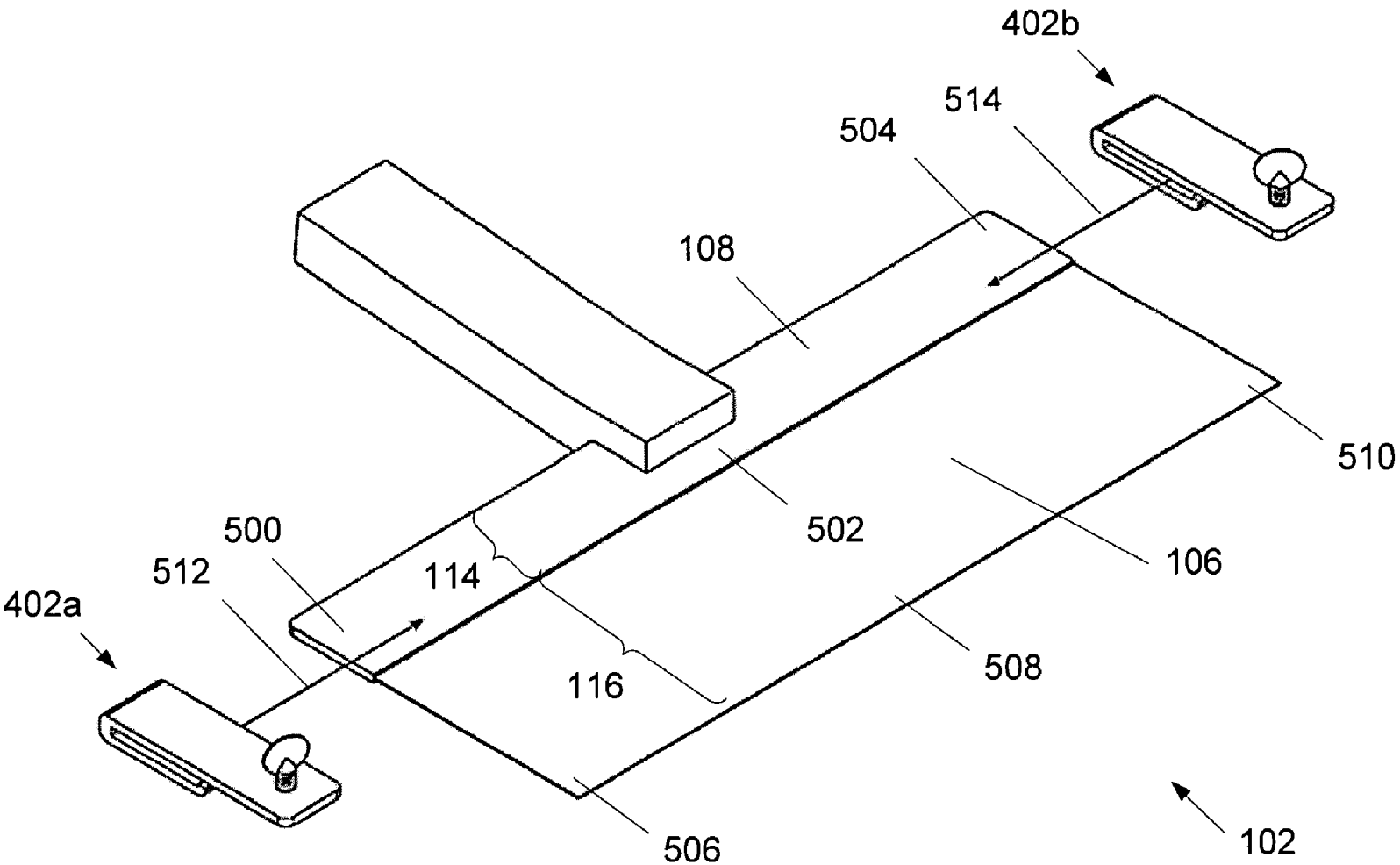
FIG. 5 is a depiction of first and second blade benders 104 being securely mounted onto drywall knife 102.

FIG. 4 is a perspective view of another assembly 400 of the present invention. Assembly 400 is similar to assembly 100 of FIG. 1, except in that blade bender 402 is used in place of blade bender 104. Blade bender 402 differs from blade bender 104 in that it is further comprised of a lower arm 804 (not shown in FIG. 4, but see FIG. 8 and FIG. 9). Such a lower arm functions as a means for securely mounting the second section 124 (see FIG. 1) to rear blade section 114. Assembly 400 is otherwise substantially identical to assembly 100 of FIG. 1. For example, assembly 400 is still comprised of backing plate 108, and blade 106 that has a rear blade section 114 and a front blade section 116. It is clear that the means for securely mounting used in apparatus 400 is removable. Reference may be had to FIG. 5.

FIG. 5 is a depiction of first and second blade benders 104 being securely mounted onto drywall knife 102. Blade bender 402*a* is mounted on the proximal side 118 (see FIG. 1) of blade 106 by sliding blade bender 402*a* in the direction of arrow 512. Similarly, blade bender 402*b* is mounted on the distal side 120 (see FIG. 1) of blade 102 by sliding blade bender 402*b* in the direction of arrow 514. In the embodiment depicted, blade benders 402*a* and 402*b* fit securely over backing plate 108. The position of blade benders 402*a* and 402*b* may be adjusted so as to alter the distance 122 (see FIG. 1) between the blade benders. Once the blade benders 402*a* and 402*b* are in the desired position, threaded screw 112 may be operated such that a mild force is applied to blade 106. This mild force acts to securely mount the blade benders 402*a* and 402*b*.

Referring again to FIG. 5, the bending of blade 106 will now be described with reference to six points. Three of these six points are disposed on the rear blade section 114; first rear point 500, middle rear point 502, and second rear point 504. These three points define plane 600 (see FIG. 6). In one embodiment, these three points are kept substantially rigid (i.e. co-planar) by backing plate 108. The remaining three points are disposed on front blade section 116; first front corner 506, middle front point 508, and second front corner 510. In the embodiment depicted in FIG. 5, back plate 108 is also on rear blade section 114, but such a back plate is not required. Any suitable means for keeping the rear blade section substantially planar may be used. It is clear from the figure that first front corner 506 and second front corner 510 are located on the corner edges of blade 106. The middle front point 508 is defined as the point disposed midway between first front corner 506 and second front corner 510. Similarly, middle rear point 502 is defined as the point disposed midway between first rear point 500 and second rear point 504. The first rear point 500 and second rear point 504 are defined as those points on the rear blade section 114 which are in the middle of the width 814 (see FIG. 8) and the middle of the second section 124 (see FIG. 1) of the upper arm. The bending of the blade 106 will now be described in terms of these points of interest.

Figure 6:
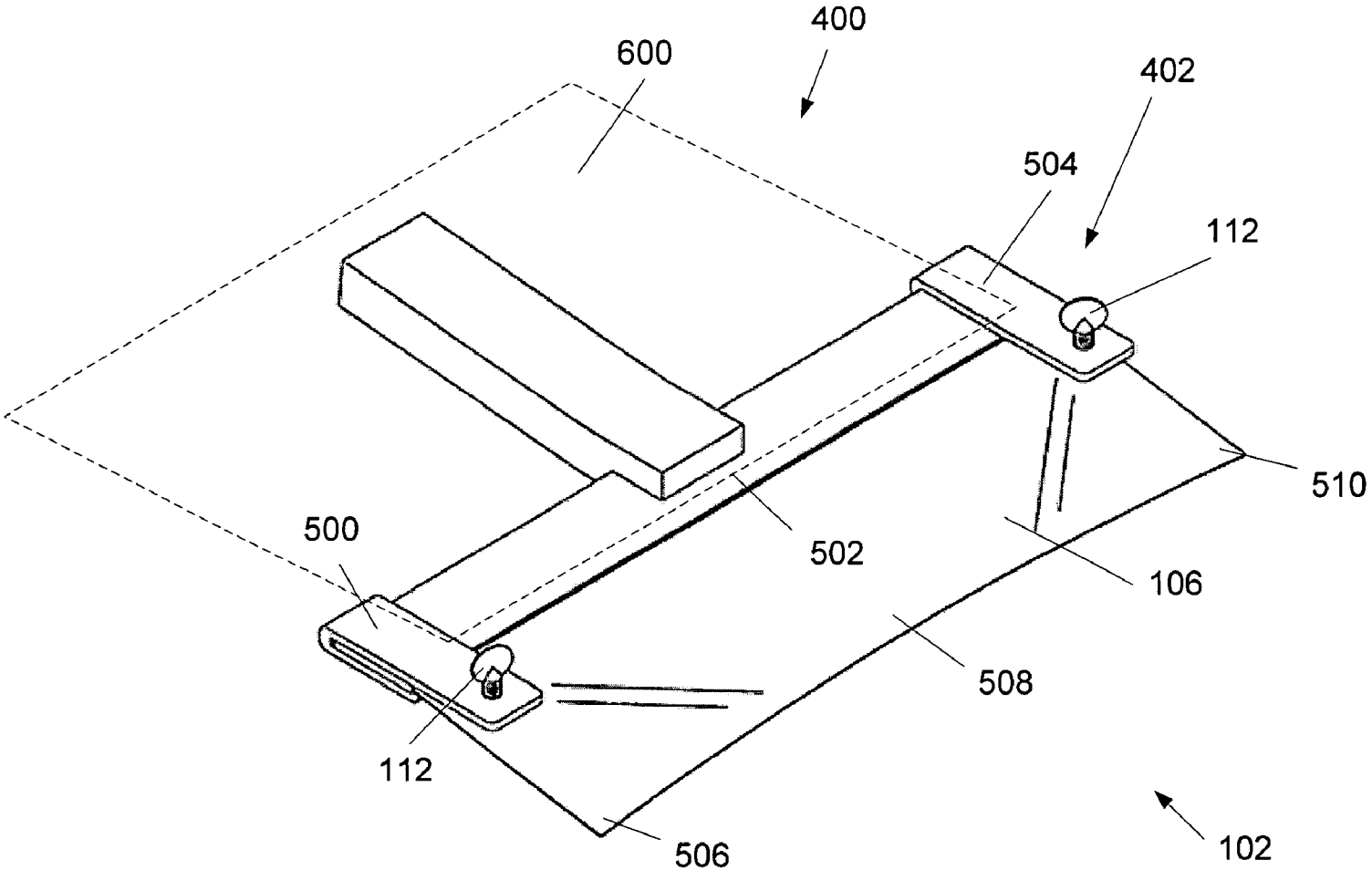
FIG. 6 is a perspective view of assembly 400 of FIG. 4.

FIG. 6 is a perspective view of assembly 400 which shows the bending of blade 106 in terms of the six points of interest; first rear point 500, middle rear point 502, second rear point 504, first front corner 506, middle front point 508, and second front corner 510. As shown in FIG. 6, first rear point 500, middle rear point 502, and second rear point 504 are all substantially co-planar and thus define plane 600. When threaded screws 112 are operated, blade 106 is deflected below the plane 600. Depending on the placement of blade benders (see, for example, distance 122 shown in FIG. 1) first front corner 506, middle front point 508, and second front corner 510 will be bent out of plane 600 to various magnitudes. This bending is best illustrated by viewing the assembly from the end.

Figure 7:
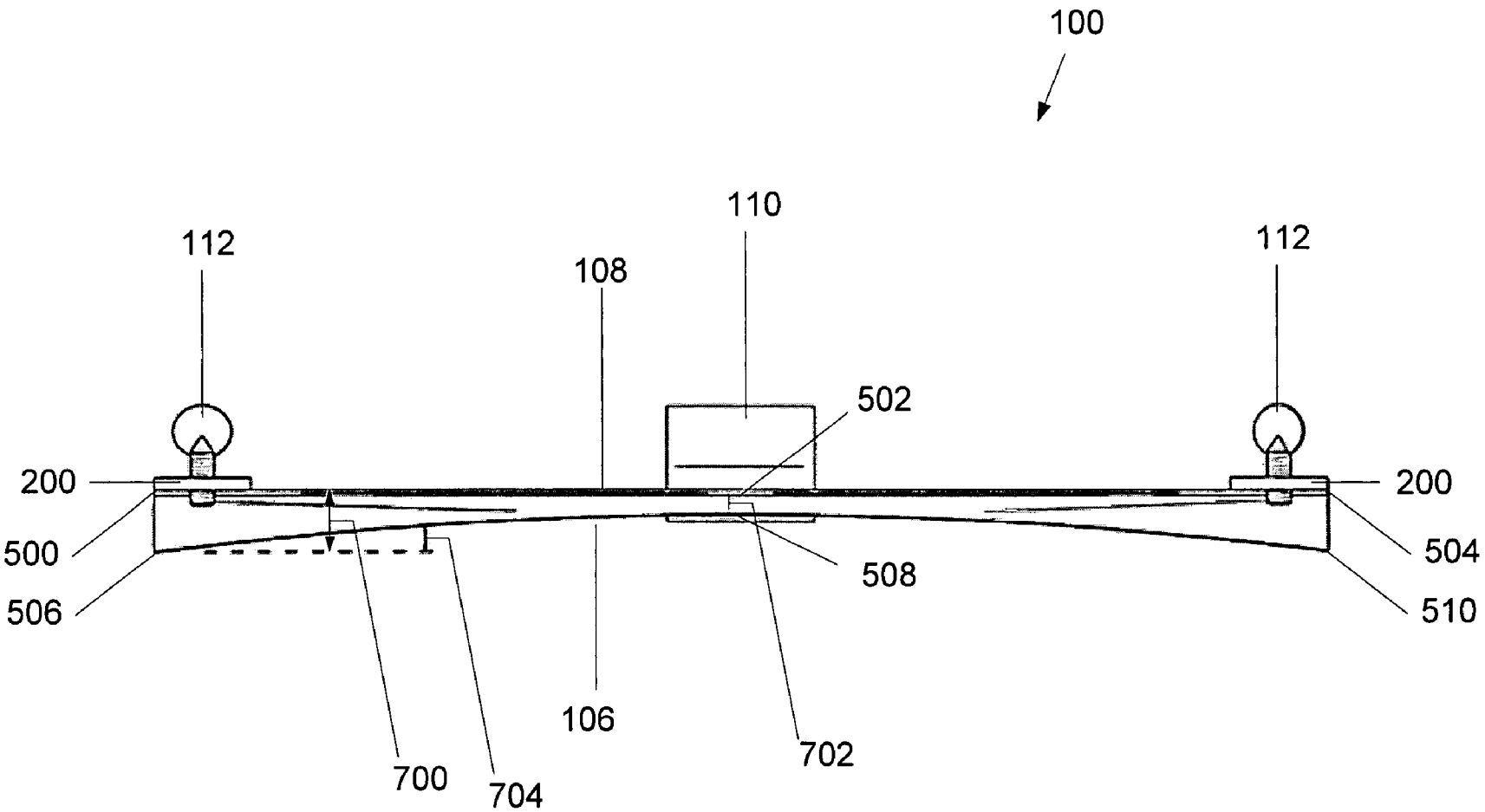
FIG. 7 is a view of assembly 100 of FIG. 1 as shown from point of view 128 of FIG. 1.

FIG. 7 is a view of assembly 100 of FIG. 1 as shown from point of view 128 (see FIG. 1). As shown in FIG. 7, assembly 100 is comprised of blade 106, back plate 108, handle 110, first and second threaded screws 112, and upper arms 200. Also illustrated in FIG. 7 are first rear point 500, middle rear point 502, second rear point 504, first front corner 506, middle front point 508, and second front corner 510.

In the embodiment depicted in FIG. 7, threaded screws 112 have been depressed so as to apply a force to blade 106, thus bending the blade. First front corner 506 and second front corner 510 have been deflected below plane 600 (see FIG. 6) by a magnitude of deflection 700. As used in this specification, the term magnitude of deflection means the distance of deflection from the plane 600 (see FIG. 6) of first front corner 506 and second front corner 510. Similarly, middle front point 508 has been deformed below plane 600 (see FIG. 6) by a magnitude of deformation 702. As used in this specification, the term magnitude of deformation means the distance of deformation from the plane 600 (see FIG. 6) of middle front point 508. In one embodiment, the magnitude of deflection 700 and the magnitude of deformation 702 are not equal; thus there is a difference 704 between magnitude of deflection and deformation. The magnitude of deflection 700 is proportional to the force applied by threaded screws 112, thus the magnitude of deflection 700 is adjustable. In one embodiment, the magnitude of deflection is adjustable such that it varies from about 0.5 millimeters to about 6 centimeters. In another embodiment, the magnitude of deflection is adjustable such that it varies from about 0.5 millimeters to about 2 centimeters. In another embodiment, the magnitude of deflection is not adjustable. The magnitude of deformation 702 is dependent upon the force applied by threaded screws 112 and by the distance 122 between the threaded screws. In one embodiment, the magnitude of deformation is adjustable such that it varies from about 0 millimeters to about 2 centimeters. In another embodiment, the magnitude of deformation is adjustable such that it varies from about 0.1 millimeter to about 1 millimeter. Likewise, the difference 704 between magnitude of deflection and deformation is adjustable from about 0.1 millimeter to about 2 centimeters. In this manner an arcuate blade may be produced.

Without wishing to be bound to any particular theory, the inventor believes that the particular curvature of the blade is advantageous to some embodiments of the invention as it increases the force applied to the filler material that is disposed under the middle front point 508, thus encouraging the filler material to enter into the seam formed by two adjacent drywall pieces. Moreover, such a particular curvature reduces the concentration of air pockets that form in the filler and steer the filler toward the center of the blade.

FIG. 7A is a perspective view of one apparatus of the present invention. In the embodiment illustrated in FIG. 7A, flat region 728 and curved region 726 are illustrated. FIG. 7B is an end view of the apparatus of FIG. 7A which shows the same regions. Toward the rear blade section of the apparatus, it is clear that the blade has only a flat region. As one moves across the surface of the blade toward the front blade section, the flat region gradually decreases in length and the curved region gradually increases in length.

FIG. 7A illustrates the curvature of one blade of the present invention. For the sake of illustration, the blade has been divided into segments; rear segment 730, first middle segment 732, second middle segment 734, third middle segment 735, and front segment 736. Each of these segments is comprised of a flat region 728 and a curved region 726. The length of the flat region 728 gradually decreases as one moves across the surface of the blade from rear to front. The length of the curved region 726 gradually increases as one moves across the surface of the blade. It should be understood that such segments are for purposes of illustration only. For the sake of simplicity, only four segments are shown, but an infinite number of segments could be illustrated. The segments illustrated in FIG. 7A are all of equal width, however, in some embodiments the segments are of unequal width. These segments are also illustrated in FIG. 7B, albeit from a different perspective.

Rear segment 730 has a flat region 728. In the embodiment depicted, the flat region 728 has a length which is equal to the length of rear segment 730; thus rear segment 730 is flat. As one moves towards the front blade section, the first middle segment 732 is encountered.

Such first middle segment 732 has a flat region 728 which is less than the length of the first middle segment 732. The length of flat region 728 of first middle segment 732 is less than the flat region 728 of rear segment 730. The remaining length of first middle segment 732 is comprised of curved region 726. The length of curved region 726 of first middle segment 732 is greater than the length of curved region 726 of rear segment 730 (e.g. rear segment 730 has no such curved region). As one continues to move towards the front blade section, second middle segment 734 is encountered.

Second middle segment 734 has a flat region 728 which is less than the length of the segment. The length of flat region 728 of second middle segment 734 is less than the flat region 728 of first middle segment 732. The remaining length of second middle segment 734 is comprised of curved region 726. The length of curved region 726 of second middle segment 734 is greater than the length of curved region 726 of first middle segment 732. As one continues to move towards the front blade section, third middle segment 735 is encountered. The length of flat region 728 of third middle segment 735 is less than that of second middle section 734. Similarly, the length of curved region 726 of third middle segment 735 is greater than that of second middle section 734. Front section 736 follows substantially the same pattern.

Figure 7C:
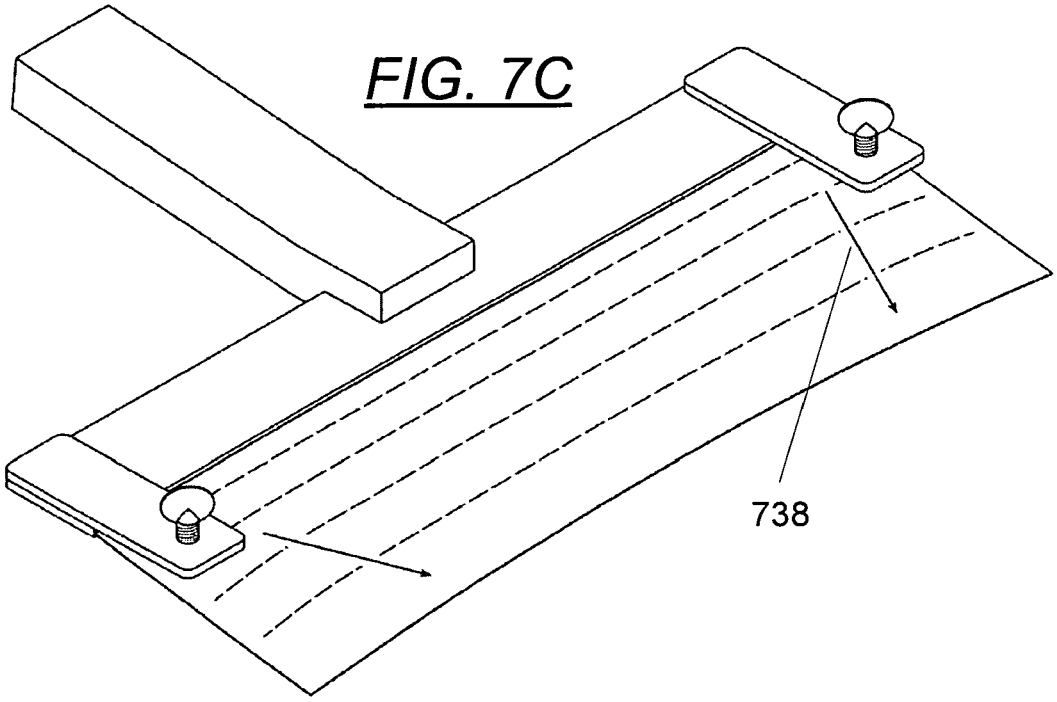
FIG. 7C and FIG. 7D are perspective and end views similar to those shown in FIG. 7A and FIG. 7B respectively that show the bending of the blade.
Figure 7D:
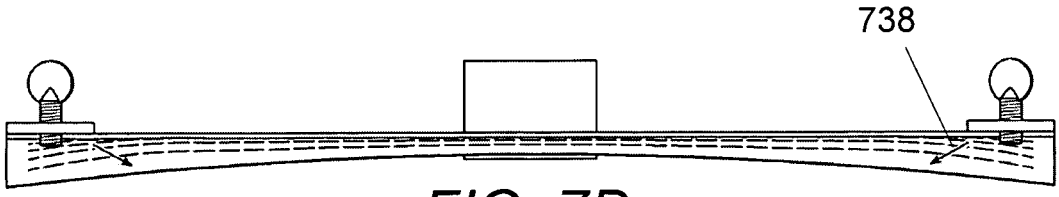

FIG. 7C is a perspective illustration of the gradual nature of the curve of one embodiment of the present invention. FIG. 7C illustrates bend lines 738. The bend lines extend toward the front blade section and extend diagonally inward toward the front middle point of the blade. FIG. 7D is an end view of the apparatus of FIG. 7C from a different perspective.

In another embodiment of this invention, a kit is assembled wherein the kit is comprised of two blade benders such as blade benders 402 as shown in FIG. 2. The blade benders in such a kit are customized for a specific blade, such as blade 106 of FIG. 1, which may be sold separately. Such blade benders 402 are one means for securely mounting to a drywall knife.

For example, an operator may purchase a first drywall knife from a first commercial vendor and a second drywall knife from a second vendor. The operator may also purchase a first and second kit, each kit containing a pair of blade benders. The blade benders in the first kit are specifically designed to have a mating configuration with drywall knifes from the first vendor. The blade benders in the second kit are specifically designed to have a mating configuration with the drywall knifes from the second vendor. It is clear that the blade benders may be custom built for any drywall knifes that are commercially available.

Referring again to FIG. 1, and as previously discussed, there are multiple means for securely mounting the second section 124 of a blade bender to rear blade section 114 of blade 106. One such means for securely mounting is lower arm 804 (see FIG. 8A).

Figure 8A:
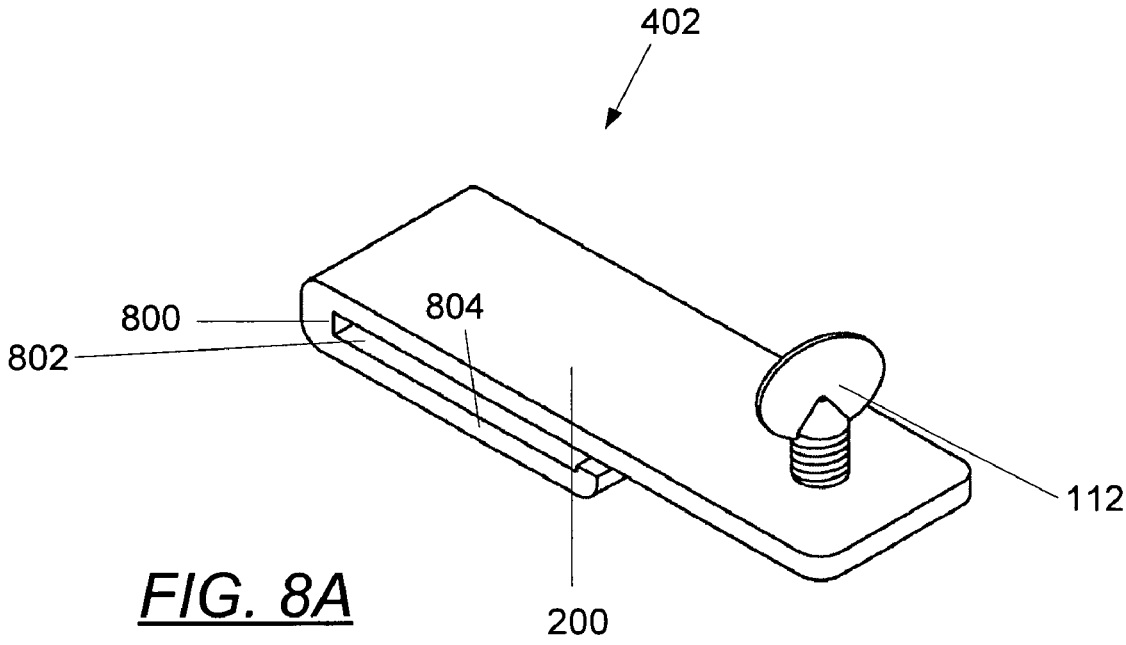
FIG. 8A is a depiction of blade bender 402 of FIG. 4.

FIG. 8A is a depiction of blade bender 402 (see FIG. 4) that clearly illustrate the use of a lower arm 804. As shown in FIG. 8A, blade bender 402 is comprised of threaded screw 112, upper arm 200, joining curve 800, and lower arm 804. Joining curve 800 is integrally joined to upper arm 200 and lower arm 804 such that gap 802 is formed. Such an integral union thus makes joining curve 800, upper arm 200 and lower arm 804 a single, unitary piece. Blade bender 402 is comprised of a plurality of sections which will now be described in detail.

Figure 8B:
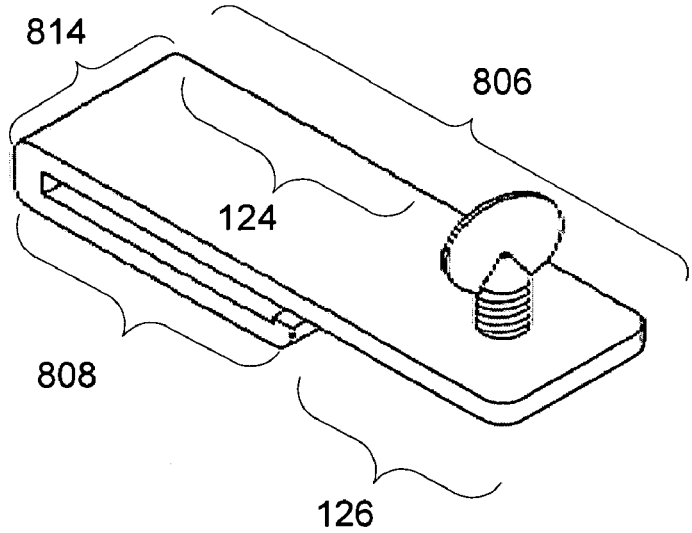
FIG. 8B is another depiction of blade bender 402 of FIG. 4.

FIG. 8B is another depiction of blade bender 402 of FIG. 4 that shows the various sections of the blade bender. Blade bender 402 is comprised upper arm 200 (see FIG. 8A) which is comprised of first section 126 and second section 124. First section 126 is configured to be disposed front blade section 116 (see FIG. 1) such that it is flexibly mounted. Second section 124 is configured to be disposed over rear blade section 114 (see FIG. 1) such that it is securely mounted. Upper arm 200 has a length 806 and a width 814.

Referring again to FIG. 8A and FIG. 8B, blade bender 402 is also comprised of lower arm 804. Lower arm 804 has a section 808 configured to be disposed under rear blade section 114 (see FIG. 1) such that it is securely mounted to rear blade section 114 and is contiguous therewith. In the embodiment depicted, section 808 of lower arm 804 has substantially the same length as second section 124 of upper arm 200. The relative configuration of section 808, second section 124, and joining curve 800 creates gap 802. Gap 802 is configured to receive and securely mount a backing plate, such as backing plate 108 of FIG. 4. In the embodiment depicted, upper arm 200 is longer than lower arm 804 (i.e. length 806 is greater than the length of section 808). In one embodiment, the upper arm 804 is from about two centimeters to about ten centimeters longer than the length of the lower arm 804 (i.e. section 126 has a length of from about two to about ten centimeters).

Figure 9:
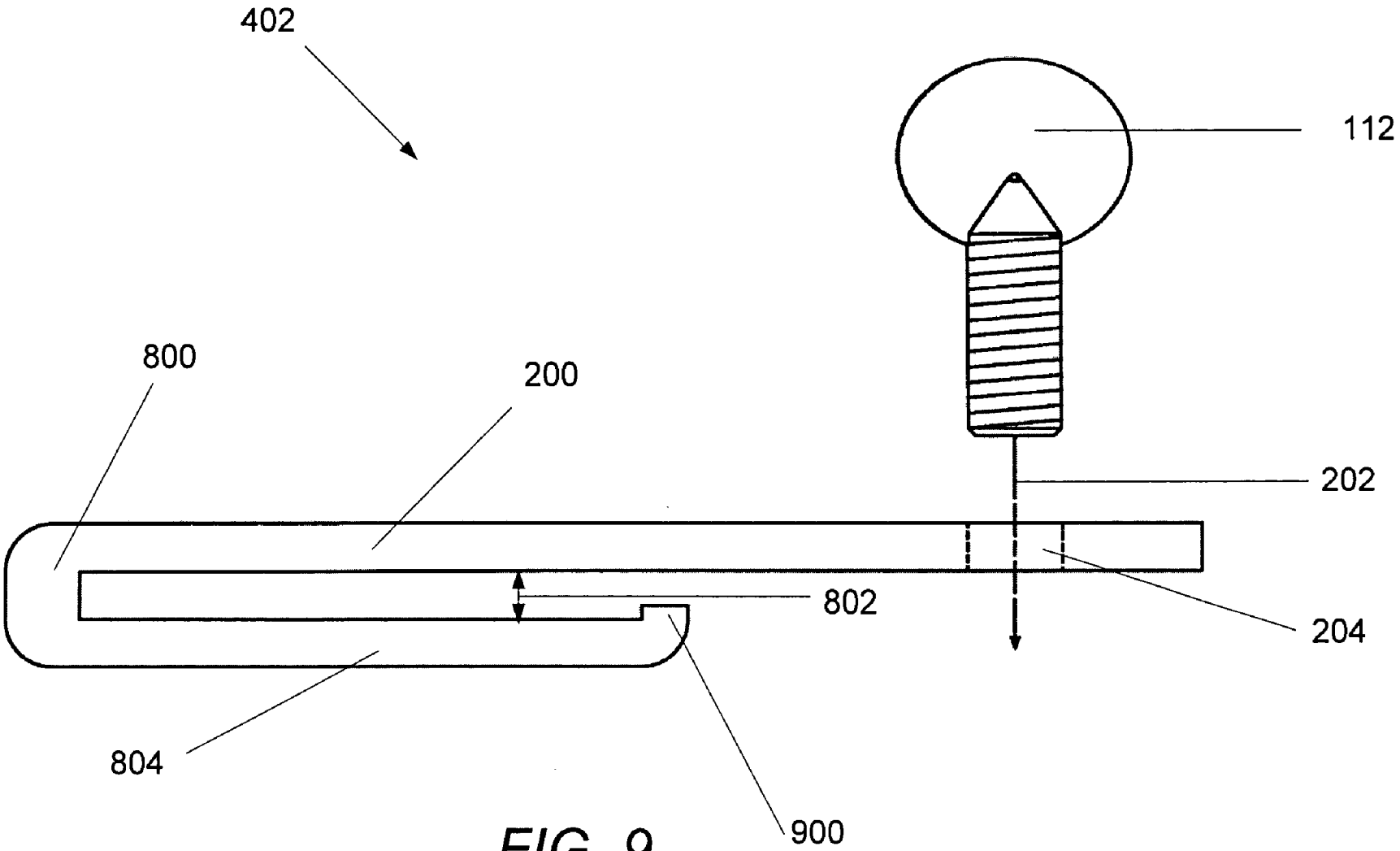
FIG. 9 illustrates the formation of gap 802 in blade bender 402.

FIG. 9 illustrates the formation of gap 802. As shown in FIG. 9, blade bender 402 is comprised of upper arm 200, lower arm 804, joining curve 800, gap 802, threaded screw 112, and threaded hole 204. In one embodiment, gap 802 is from about 0.1 millimeter to about 5 millimeters. In another embodiment, gap 802 is from about 0.1 millimeters to about 10 millimeters. Gap 802 has a contour configured to be complimentary to the contour of the backing plate for which it is designed. In this manner, the contour of the gap is designed have a mating configuration with the backing plate. Threaded hole 204 is configured to receive threaded screw 112. When threaded screw 112 is operated, such operation causes threaded screw 112 to translate through threaded hole 204, thus translating in direction 202.

Figure 10A:
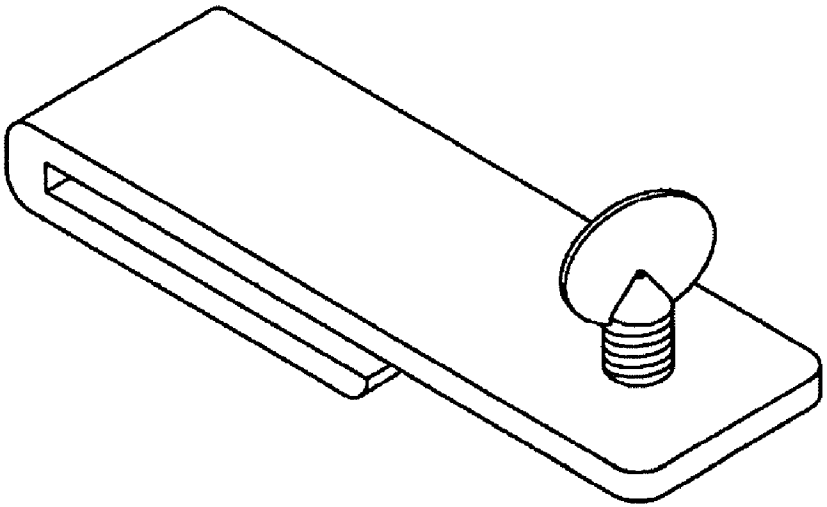
FIG. 10A and FIG. 10B are perspective and side views of another blade bender of the present invention.
Figure 10B:
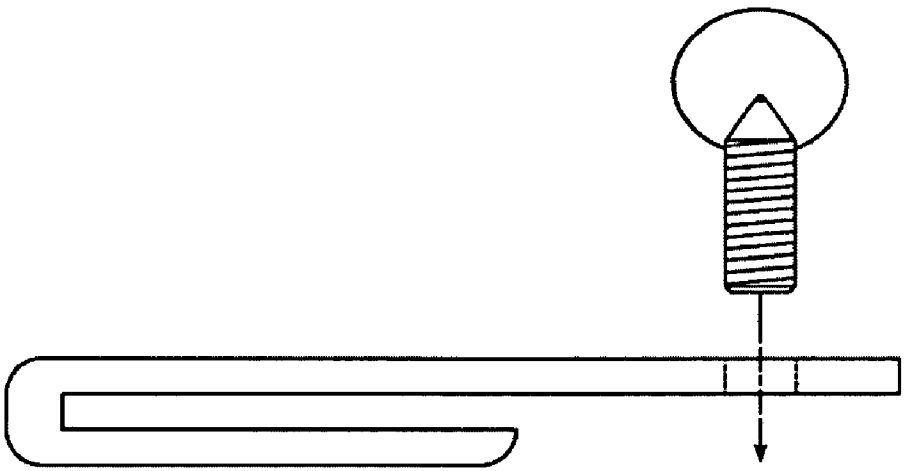

Referring again to FIG. 9, lower arm 804 is further comprised of protrusion 900. Protrusion 900 is operatively configured to promote the secure attachment of the blade bender to a drywall knife. For example, and with reference to FIG. 1, protrusion 900 is configured to allow secure attachment of blade bender 402 to back plate 108. As shown in FIG. 1, back plate 108 has a raised edge which protrusion is designed to fit (i.e. a mated configuration). Protrusion 900 is optional, thus, in one embodiment a blade bender is constructed that omits such a protrusion. One such blade bender is illustrated in FIG. 10A and FIG. 10B.

It is therefore, apparent that there has been provided, in accordance with the present invention, an assembly for bending the blade of a drywall knife. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An assembly for bending the blade of a drywall knife comprising a. a first blade bender comprised of a first upper arm wherein said first upper arm is comprised of a first threaded hole and a first threaded screw;

b. a second blade bender comprised of a second upper arm wherein said second upper arm is comprised of a second threaded hole and a second threaded screw;

c. a drywall knife comprised of a blade with a proximal side and a distal side; said blade being further comprised of a handle, a rigid rear blade section and a flexible front blade section, said rigid rear blade section being permanently connected to said flexible front blade section over the entire width of said blade such that the connection is fixed, said rigid rear blade section being contiguous with said handle;

d. said first blade bender and said second blade bender are disposed on said blade such that said first blade bender is at said proximal side and said second blade bender is at said distal side;

e. said first blade bender and said second blade bender are each comprised of a first section contiguous with, and flexibly mounted to, said front blade section and a second section contiguous with, and securely mounted to, said rigid rear blade section;

f. said front blade section is comprised of i. a first front corner on said proximal side;

ii. a second front corner on said distal side;

iii. a middle front point disposed midway between said first front corner and said second front corner;

g. said first threaded screw is disposed in said first section of the first blade bender and said second threaded screw is disposed in said first section of the second blade bender such that operation of an adjustable deflecting screw, selected from the group consisting of said first threaded screw, said second threaded screw, and combinations thereof, causes said adjustable deflecting screw to apply a force to said blade, causing said blade to bend such that the middle front point is deflected downward by a magnitude that is proportional to the force applied by the adjustable deflecting screw.

2. The assembly for bending the blade of a drywall knife as recited in claim 1, wherein a. said rear blade section is comprised of i. a first rear point disposed under said first blade bender;

ii. a second rear point disposed under said second blade bender;

iii. a middle rear point disposed midway between said first rear point and said second rear point;

iv. said first rear point, said second rear point, and said middle rear point define a first plane;

v. said rear blade section is substantially rigid;

b. when said adjustable deflecting screw is not applying said force to said blade, said first front corner, said second front corner, and said middle front point are all substantially co-planar with respect to said first plane, c. when said adjustable deflecting screw is applying said force to said blade; said first front corner and said second front corner are deflected out of said first plane by a magnitude of deflection.

3. The assembly for bending the blade of a drywall knife as recited in claim 2, wherein said magnitude of deflection is proportional to said force, thus said magnitude of deflection is adjustable by operation of said adjustable deflecting screw.

4. The assembly for bending the blade of a drywall knife as recited in claim 3, wherein, when said adjustable deflecting screw is applying said force to said blade, said middle front point is deflected below said first plane by a magnitude of deformation; and said magnitude of deflection is greater than said magnitude of deformation.

5. The assembly for bending the blade of a drywall knife as recited in claim 4, wherein said magnitude of deflection is from about 0.1 millimeters to about 2 centimeters.

6. The assembly for bending the blade of a drywall knife as recited in claim 5, wherein said magnitude of deformation is from about 0.1 millimeters to about 2 centimeters.

7. The assembly for bending the blade of a drywall knife as recited in claim 6, wherein the difference between magnitude of deflection and deformation is from about 0.1 millimeters to about 2 centimeters.

8. The assembly for bending the blade of a drywall knife as recited in claim 7, wherein a. said first blade bender is further comprised of i. a first lower arm;

ii. a first joining curve integrally joined to said first upper arm and said first lower arm such that a first gap is created between said first upper arm and said first lower arm;

iii. said first upper arm is longer than said first lower aim;

b. said second blade bender is further comprised of i. a second lower arm;

ii. a second joining curve integrally joined to said second upper arm and said second lower arm such that a second gap is created between said second upper arm and said second lower arm;

iii. said second upper arm is longer than said second lower arm;

c. said first gap and said second gap are configured to receive and securely mount said rear blade section.

9. The assembly for bending the blade of a drywall knife as recited in claim 8, wherein said first lower atm and said second lower arm are contiguous with said rear blade section.

10. An assembly for bending the blade of a drywall knife comprising a. a drywall knife comprised of a handle, a blade with a proximal side and a distal side; said blade being further comprised of a rigid rear blade section and a flexible front blade section, said rigid rear blade section being permanently connected to said front blade section over the entire width of said blade such that the connection is fixed, said rigid rear blade section being contiguous with said handle;

b. a first blade bender comprised of a first upper arm wherein said first upper arm is comprised of i. means for applying a force to said front blade section;

ii. means for securely mounting to said rear blade section;

c. a second blade bender comprised of a second upper arm wherein said second upper arm is comprised of i. means for applying a force to said front blade section;

ii. means for securely mounting to said rear blade section;

d. said first blade bender and said second blade bender are disposed on said blade such that said first blade bender is at said proximal side and said second blade bender is at said distal side;

e. said rear blade section is comprised of i. a first rear point disposed under said first blade bender;

ii. a second rear point disposed under said second blade bender;

iii. a middle rear point disposed midway between said first rear point and said second rear point;

iv. said first rear point, said second rear point, and said middle rear point define a first plane;

v. said rear blade section is substantially rigid;

f. said front blade section is comprised of i. a first front corner on said proximal side;

ii. a second front corner on said distal side;

iii. a middle front point disposed midway between said first front corner and said second front corner;

g. when said means for applying a force to said front blade section is not applying said force to said blade front blade section, said first front corner, said second front corner, and said middle front point are all substantially co-planar with respect to said first plane, and said first and said second section of the first and second blade benders are contiguous with the flexible front blade section over their entire length;

h. when said means for applying a force to said front blade section is applying said force to said blade front blade section, said first front corner and said second front corner are deflected out of said first plane by a magnitude of deflection, and said middle front point is deflected below said first plane by a magnitude of deformation; and said magnitude of deflection is greater than said magnitude of deformation.

11. The assembly for bending the blade of a drywall knife as recited in claim 10, wherein said magnitude of deflection is from about 0.1 millimeters to about 2 centimeters.

12. The assembly for bending the blade of a drywall knife as recited in claim 11, wherein when said means for applying a force to said front blade section is applying said force to said blade front blade section, said blade develops a bend line that extends diagonally inward toward said front blade section.

13. The assembly for bending the blade of a drywall knife as recited in claim 12, wherein said means for applying a force of said first blade bender and said means for applying a force of said second blade bender are separated by a distance of from about three centimeters to about sixty centimeters.

14. The assembly for bending the blade of a drywall knife as recited in claim 13, wherein said means for applying a force of said first blade bender and said means for applying a force of said second blade bender are separated by a distance of from about fifteen centimeters to about thirty centimeters.

* * * * *